United States Patent [19]

Carlson

[11] 4,223,801

[45] Sep. 23, 1980

[54] AUTOMATIC PERIODIC DRUG DISPENSING SYSTEM

[76] Inventor: Torsten S. Carlson, 1077 Wicke Ave., Des Plaines, Ill. 60018

[21] Appl. No.: 872,496

[22] Filed: Jan. 26, 1978

[51] Int. Cl.[2] ..... B65D 83/04

[52] U.S. Cl. ..... 221/3; 368/10; 206/533; 206/534; 221/5; 221/15; 221/69

[58] Field of Search ..... 221/2–5, 221/15, 69, 185, 199; 116/121; 206/534, 538, 539, 533, 459; 58/152 R, 152 B, 152 T, 57.5, 127 R, 1, 16 R; 340/539

[56] References Cited

U.S. PATENT DOCUMENTS

| | | | |
|---|---|---|---|
| 729,527 | 6/1903 | Baynes | 221/3 |
| 927,007 | 7/1909 | Scritchfield | 116/121 X |
| 2,005,158 | 6/1935 | Nicolson | 58/152 R |
| 2,098,133 | 11/1937 | Carnahan | 340/539 X |
| 3,236,369 | 2/1966 | Moore | 206/539 X |
| 3,395,829 | 8/1968 | Cogdell et al. | 221/15 |
| 3,474,617 | 10/1969 | Robinson et al. | 58/152 B X |
| 3,762,601 | 10/1973 | McLaughlin | 221/2 |
| 3,876,269 | 4/1975 | Fisher et al. | 206/534 X |
| 3,911,856 | 10/1975 | Ewing | 206/534 X |
| 4,063,410 | 12/1977 | Welling | 58/57.5 X |

FOREIGN PATENT DOCUMENTS

| | | | |
|---|---|---|---|
| 366683 | 1/1923 | Fed. Rep. of Germany | 206/459 |
| 1921175 | 2/1971 | Fed. Rep. of Germany | 221/3 |
| 2138780 | 3/1973 | Fed. Rep. of Germany | 58/152 B |

*Primary Examiner*—Robert J. Spar
*Assistant Examiner*—Edward M. Wacyra
*Attorney, Agent, or Firm*—Hill, Van Santen, Steadman, Chiara & Simpson

[57] ABSTRACT

An automatic periodic pharmaceutical preparation dispenser, for alerting patients under medication when specific drugs are to be taken. The device provides orderly storage of a plurality of drugs to be taken in a given time period with a coding associated with each pill. The device further provides a timer having a signal device responsive thereto to indicate when a specific medicament is to be taken and at a predetermined time interval relative to previously administered drugs. In the several embodiments shown, the timer comprises a clock mechanism; a time chip totalizer; and a signal responsive paging device all of which are arranged to indicate when and which pharmaceutical preparation is to be taken.

13 Claims, 16 Drawing Figures

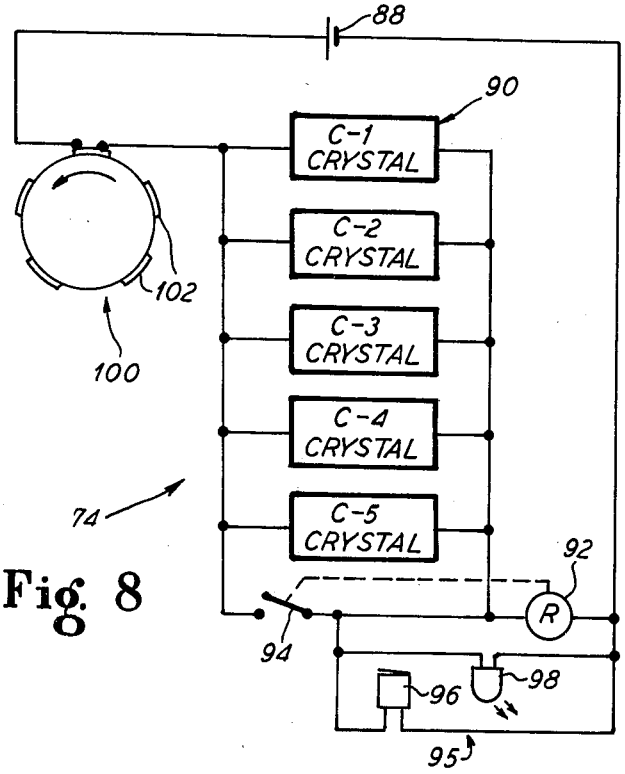
Fig. 8
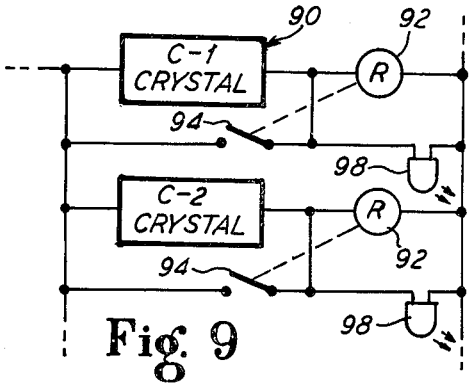
Fig. 9
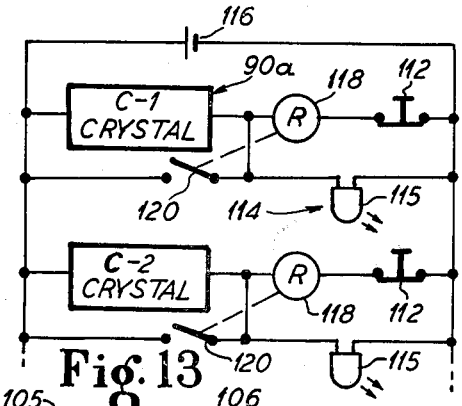
Fig. 13
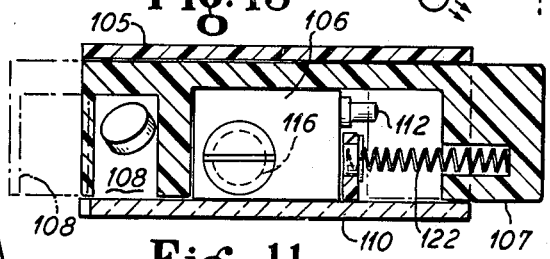
Fig. 11
Fig. 10
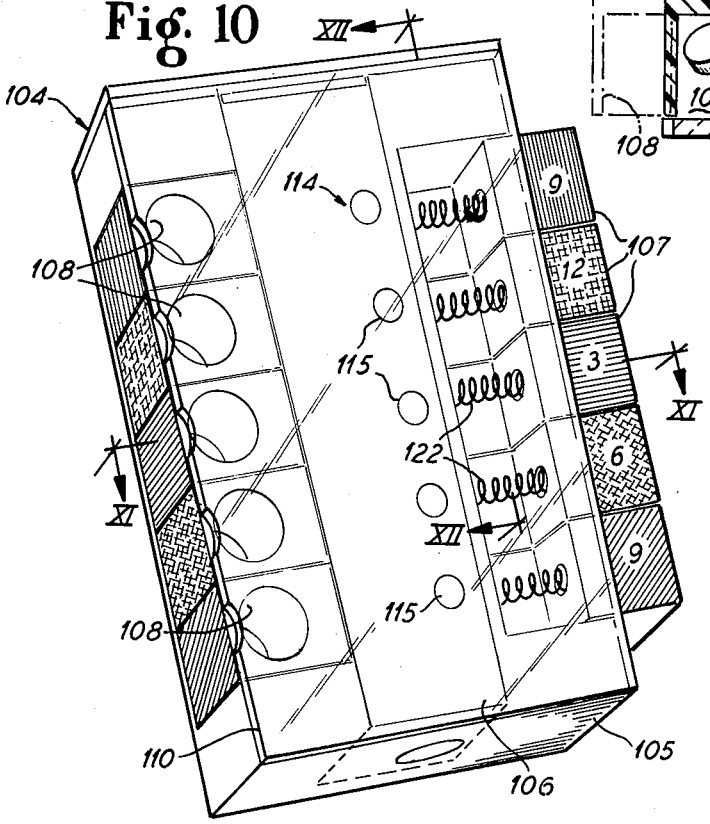
Fig. 12
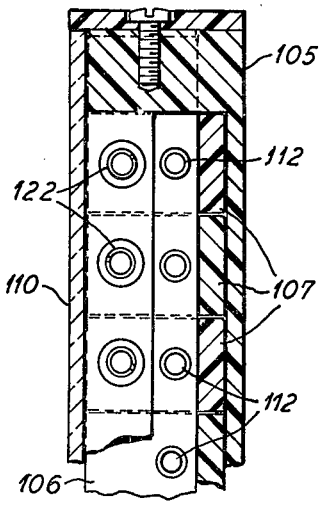

AUTOMATIC PERIODIC DRUG DISPENSING SYSTEM

BACKGROUND OF THE DISCLOSURE

The extreme importance of taking timely medication and, when taking certain combinations of pharmaceuticals, making sure that they are administered in a proper sequence is obvious to those skilled in the medical field. However, heretofore, no dependable, simple means of administering various pharmaceutical preparations in a timed and sequenced manner was available to those under medication. The importance of this cannot be overemphasized since those versed in pharmacodynamics understand the serious difficulties which may result in excessive dosage or failure to maintain sufficient levels of drugs in the body's system to be an effective treatment for a particular malady. This may be further aggravated by the side actions of certain drugs which can diminish an individual's mental capacity i.e., memory or awareness of his actions. Further, as is frequently the case, the chronically ill and the eldery patients are often prescribed a plurality of drugs, vitamins or curative substances whose frequency and sequence may be difficult to keep track of, even with full control of one's faculties. Moreover, since the rate of absorption or detoxification of various drugs to be admininistered during the course of a day may vary widely, it is essential that a record or chart be utilized to be sure the proper medicament is taken with a suitable elapsed time between doses. Generally, as is the case with most people, these records are not kept up and errors can and often do occur; sometimes with fatal consequences.

The effects of administering repeated doses of some drugs may be cumulative if insufficient time has elapsed between doses resulting in a variety of serious side actions, especially in regard to the nervous system, cardiovascular system or respiration system or even in the gastrointestinal track. Further, it is frequently required for some patients to be prescribed a buffer medicament to lessen or eliminate the adverse effects of particular prescribed pharmaceutical preparations.

Past methods of drug dispensing typically provided a pill container with a cap therefor which carried a time indicator that was set manually to the time interval when a next pill was to be taken. However, when a plurality of diverse types of pills and/or capsules are required by a patient, it is exceedingly difficult to use these cap mounted time indicators as an effective means for drug dispensing.

Contraceptive pill dispensers are also known but these devices rely on memory and are generally dispensed only at the rate of approximately one per day, there being no signal device to alert the user that a given preselected pill is to be taken.

It would therefore be a decided advance in the art to provide a drug dispenser which would automatically advise a patient under medication exactly when to take a specific pill selected from a series of pills which are to be taken over the course of a day and which series of pills are conveniently carried by the drug dispenser.

SUMMARY OF THE INVENTION

My invention is directed to an automatic periodic drug dispensing device for administering predetermined dosages of drugs or curative substances to a patient which is reliable and simple to use. In its simplest form the invention provides a portable multi-compartment container with the containter filled with one day's requirements of prescribed drugs and in which each compartment is coded to instantaneously identify the drug carried therein. Preferably, the compartments are arranged in the order with which the drugs are to be administered. The dispensing device also includes a timer which comprises a watch or clock to measure the elapsed time between doses of the drugs to be taken with a coded signal "dot" affixed to the watch face to indicate the time, and the specific drug which is to be taken. The coded dot n the watch face, indicating a specific hour, would obviously identify the pill to be taken by matching the coding on the dot with the coding on the pill compartment. Thus a visual signal is provided as to when each of the series of drugs is to be taken without the need to rely on memory or charts or cap indicators. As many "dots" and pill compartments will be utilized to conform to a specific patient's drug needs over the course of a day.

In another form of my invention I provide a multi-compartment transportable drug storage container with an integral timing device which may be set to signal (acoustically or visually) each time a pill or capsule is to be taken. A coding is also used to identify an individual pill contained in a specific compartment. The signal emitted by the timing device is stopped by depressing a reset button which also starts the next timed interval for administering a subsequent drug dose. A paging system can also be utilized to activate the signal which is adapted to receive paging transmissions only in accordance with the time sequences required by an individual patient's drug needs.

A further modification provides a rotary step-switch which is arranged to dispense an appropriate pill automatically, by rotating the step-switch to terminate an emitted signal and reset for the next timed interval. Herein, the multi-chamber pill storage container is incorporated with the step-switch whereby rotating the step-switch exposes an appropriate pill for removal from the storage chamber by bringing the pill chamber into alignment with a complementary opening in a non-rotating cover sleeve, carried by the timing device and extending around the storage container.

Another modification of my invention provides a multi-compartment pill storage container utilizing a timing device to sequentially activate an appropriate signal of a plurality of signaling means and which signaling means are sequentially turned off with individual reset buttons which require shifting a specific elongated slide member against the reset button. Each slide member includes at one end thereof a storage compartment which when shifting the slide member to a reset position moves the compartment to an exposed position clear of a covering plate for retension of the pills when in a stored position. The pill can then be removed after which the slide member is released to begin a subsequent timed interval for determining when the following pill is to be administered.

Still another form of my invention provides an electrical timed automatic signal drug dispensing device which provides for the storage and coding of a day's requirements of prescribed drugs and having a reset means associated with a timing device which is provided with a special connection to a home phone system. In the event a patient is unable to take the prescribed medicament and accordingly unable to reset the device, after a short time delay an alerting message will be sent to a designated party by means of the phone connection warning of the patient's condition.

It is a principal object of this invention to provide an automatic periodic drug dispensing device for administering predetermined doses of drugs to a patient which is reliable and simple to use.

Another object of the present invention is to provide an automatic periodic dispensing device for administering daily predetermined doses of drugs to an individual under medication.

Still another object of this invention is to provide a compact portable drug dispensing device which will automatically indicate to a patient the specific time and the particular prescribed drug to be taken.

Yet another object of this invention is to provide a portable drug dispensing device which will alert a patient when a drug is to be taken by a signal, emitted by a signaling means which signal is terminated only with the administering of an appropriate drug.

Another object of this invention is to provide a self-contained automatic periodic pharmaceutical dispensing device which is adapted to receive certain timely paging signals to produce a discernible signal, indicative of instances for administering certain prescribed pills, which signal is terminated by actuation of a reset means.

These and other objects and advantages of the invention will be readily apparent from the following description of several embodiments thereof, taken in conjunction with the accompanying drawings although variations and modifications may be effected without departing from the spirit and scope of the novel concepts embodied in the disclosure.

DESCRIPTION OF THE DRAWINGS

FIG. 8 is an electrical circuit diagram of the timing device used in the FIG. 5 embodiment;

FIG. 9 is a fragmentary electrical circuit diagram of an alternate timing device arrangement which may be used in the FIG. 5 embodiment;

FIG. 10 is a perspective view of still another embodiment of the invention comprising a portable drug dispensing device;

FIG. 11 is a transverse sectional view taken generally along the line XI—XI of FIG. 10;

FIG. 12 is a fragmentary vertical sectional view taken generally along the line XII—XII of FIG. 10;

FIG. 13 is a fragmentary electrical circuit diagram of the timing device used in the FIG. 10 embodiment;

DETAILED DESCRIPTION OF THE INVENTION

Figure 1:
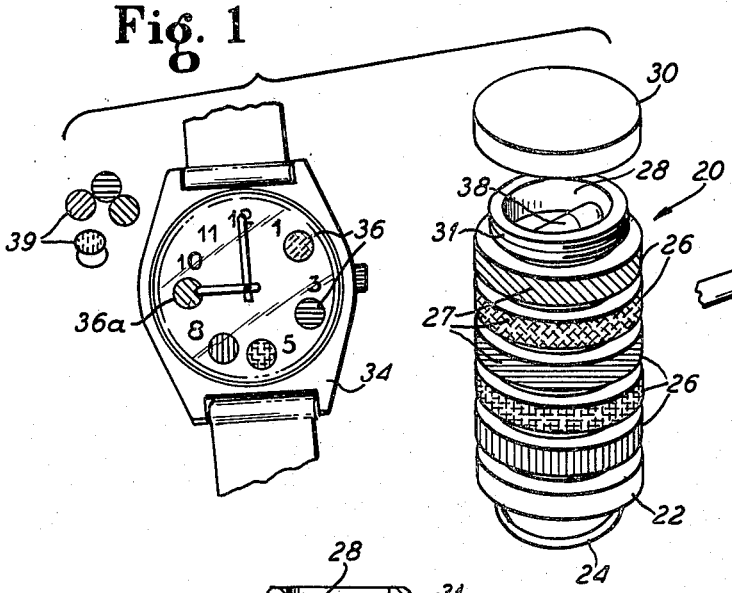
FIG. 1 is a perspective view of a multi-compartment pill storage container which together with a timing device utilize the concepts of the present invention.
Figure 2:
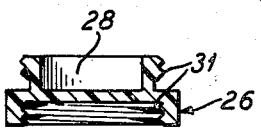
FIG. 2 is a sectional view of one of the compartments of the pill storage container shown in FIG. 1.

In the simplest form of my invention, as shown in FIG. 1, a multi-chamber pill storage container stack 20 includes a base section 22, a plurality of individual container sections 26 and a cap portion 30 all interconnectable to form a unitary container stack which may be carried by an individual under medication in a pocket or attached to a belt or clothing by means of a ring 24, provided on the base section 22. Each of the container sections 26 includes a pill or capsule chamber 28 wherein one day's drug requirements may be stored with each chamber 28 holding a specific drug to be administered at a specific time of day. The cap portion 30 encloses the chamber 28 of the topmost container section 26. Preferably, the cap, base and container sections are interconnected by means of threads 31 in order to easily disconnect the various sections to gain access to the drugs contained therein.

The outer exposed surface of each container section 26 is individual coded, as for example with a band of color 27, in order to readily identify each of the variety of pills or capsule to be taken during the course of a day.

A timing device 34, which as shown in FIG. 1, comprises a wrist watch, is provided with coded "dots" 36 which are affixed to the watch face crystal by means of a suitable pressure sensitive adhesive, to indicate the specific hours when medicaments are to be administered. Each dot 36 is color coded to match the color coding of the various container sections 26, whereby the hour hand of the watch indicates the individual pill to be taken by identifying one of the colored dots whereupon the container section 26 with the matching color is opened to provide the appropriate pill. In FIG. 1 for example, at 9:00 the dot **36*a* is lined for blue and signals the hour when capsule 38 in the top chamber 28 of container 26, also lined for blue, is to be taken. Further, at 2:00, 4:00, 6:00 and 7:00 the coded dots 36 affixed to the watch face also signal the hours when subsequent pills or capsules are to be taken. In addition, if medication is to be taken over a 24 hour period, additional coded dots 39 may be utilized, which dots may be displaced radially of the first group of dots when being affixed to the watch face to indicate a second 12 hour period. It will be understood that the storage container stack 20 will include one coded container section 26 to match each colored dot 36 affixed to the watch face. Thus, the timing device 34 will signal the time to take a prescribed drug and the color coding will identify the specific pill or capsule to be taken. Obviously the dots 36** may be coded in other ways in addition to the use of color, as for example the use of letters or symbols or braille indications.

Figure 3:
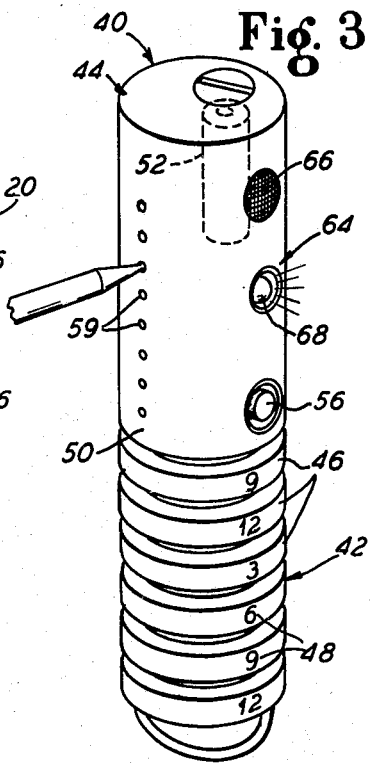
FIG. 3 is a perspective view of another embodiment of the present invention in which all of the elements of the device are included in a compact, portable drug dispensing device.

The embodiment of FIG. 3 shows a portable, unitary drug dispensing device 40 having a multi-chamber, pill storage container stack 42 and a timing means 44. The container stack 42 includes a plurality of container sections 46, which may be identical to the container sections 26 of the FIG. 1 embodiment complete with storage chambers 28 and also being interconnected through the use of threads 31. The coding means, as shown in FIG. 3, however, utilizes hour identifying digits 48 to indicate the specific hour when a pill contained within the storage chamber 28 of each section 46 is to be taken. The timing means 44 is provided with a threading connection (not detailed) at its lower end 50 to provide means of connecting the container stack 42 to the timing means 44.

Figure 4:
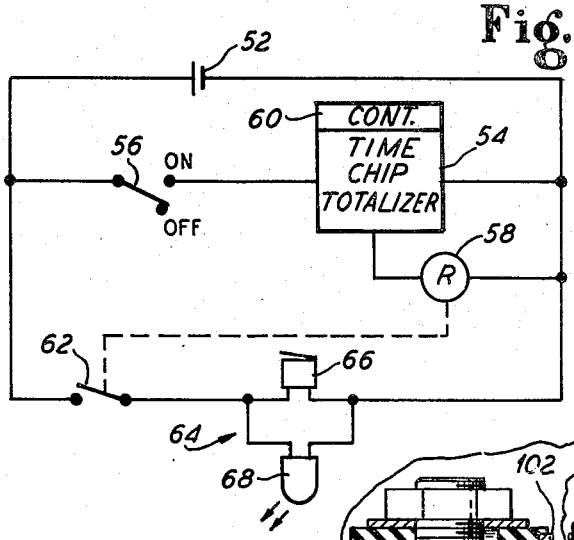
FIG. 4 is an electrical circuit diagram of the timing device used in the FIG. 3 embodiment.

The timing means 44 includes a suitable electrical circuit as shown in FIG. 4, having a galvanic cell 52 powering a time chip totalizer 54 through a normally closed reset switch contact 56. The totalizer 54 includes the usual counter arrangement (not detailed) to produce an output signal to energize a relay coil 58 after a preset interval of time. This time interval may be adjusted from outside the portable dispensing device 40 through a series of access openings 59 to set an adjustment control 60 of the totalizer 54. Time interval settings may accordingly be easily made with the aid of a pointed object such as a pencil or the like. In some instances, however, it may be desirable that the time settings are not readily accessible to tampering and may only be preset with the dismantling of the time chip totalizer from the device by a physician or pharmacist.

In operation, after a predetermined time interval the time chip totalizer 54 energizes the relay coil 58 which cause its normally open relay contacts 62 to close and complete a circuit to the interval signaling means 64. While the signaling means 64, as shown in FIGS. 3 and 4, includes a buzzer 66 and a signal light 68, other signaling means may be utilized as those skilled in the art will readily appreciate as well as various other circuit arrangements to provide the desired mode of operation. Further, the timing means 44 may also be used with a single drug storage container in place of the container stack 42 when a patient is required to take only a single type of drug at spaced time intervals over the course of a day.

Figure 5:
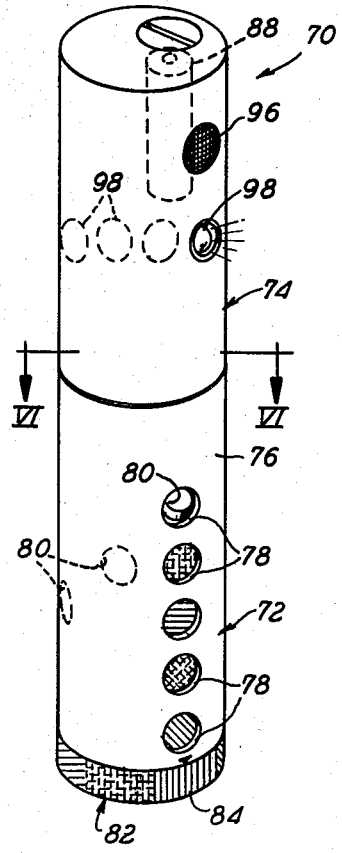
FIG. 5 is a perspective view of another embodiment of the present invention somewhat similar to the FIG. 3 embodiment.
Figure 7:
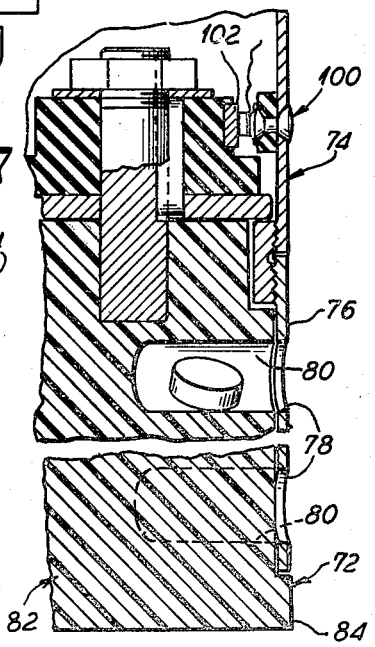
FIG. 7 is an enlarged fragmentary sectional view taken generally along the line VII—VII of FIG. 6.
Figure 6:
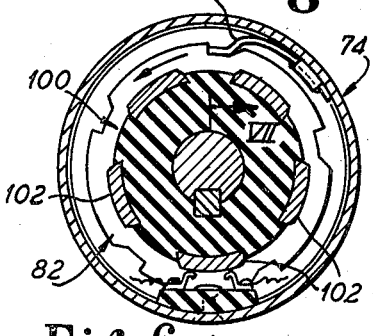
FIG. 6 is a transverse sectional view taken generally along the line VI—VI of FIG. 5.

In the FIG. 5 embodiment a portable automatic drug dispensing device 70 is shown to include a multi-chamber pill storage container means 72, holding the prescribed drugs to be administered during one day, and a timing means 74. The container means 72 comprises an outer sleeve portion 76 having a series of aligned access openings 78 therethrough for providing sequenced communication with individual pill storage chambers 80 in order of their use during the course of a day. The pill storage chambers 80 are formed in a spiral fashion about the periphery of a rotary member 82, snugly carried within the outer sleeve 76 and terminating in a knob portion 84 extending from the lower end of the sleeve 76.

In using the dispensing device 70, each of the chambers 80 is filled with a prescribed pill or capsule to be taken in order of administering. Each chamber is color coded to facilitate loading the container means 72 and to identify an individual pharmaceutical preparation. The rotary member 82 is rotatably secured to the lower end of the timing means 74 with a detent means 86 arranged to fix the position of each of the chambers 80 of the rotary member 82 in alignment with a complementary one of the access openings 78 in sequential, one-way rotary steps. Herein, an appropriate drug is made available to a patient in a timely and orderly fashion commensurate with the rotation of the member 82, by turning the knob portion 84, to provide a circuit reset function as will be described.

As best seen in FIG. 8 the timing means 74 is powered by a galvanic cell 88 having an electrical connection to each of a series of crystal detectors 90. Each of the series of crystals 90 is programmed to respond to a different, predetermined transmitted paging signal to energize a relay coil 92 and close its normally open contacts 94 to complete a circuit to signal means 95. With this arrangement the automatic drug dispensing device 70 will preferably be made available to individuals under medications by a druggist or doctor who would rent these units and provide the required paging transmissions and related services for his patients. Herein, the incorporation of certain crystal detectors 90, designated C-1 to C-5, are chosen to receive certain paging signal transmissions which correspond to the patient's need for medication. For example, the crystal C-1 of the plurality of crystals 90 would only be receptive of a paging signal transmitted at 9:00 A.M. The paging signals (Radio U.H.F. frequency) would be automatically broadcast by supplier of the dispensing device 70 at regular minimally spaced time intervals of every hour. Now should the patient require an additional dose of medicament at 10:00 A.M. the second crystal C-2 would be programmed to receive the next broadcast hourly signal. If the patient's third dose required an interval of two hours to pass after receiving the second dose, the crystal C-3 would be arranged to receive the 12:00 paging signal while the signal broadcast at 11:00 A.M. would go undetected. Further, others utilizing this dispensing device could make use of any paging signals transmitted in accordance with their own requirements for medication and by having the appropriate crystals installed in their individual units. Obviously, the crystals C-4 and C-5 and others if required will also be programmed to receive only appropriate paging signals from those broadcast in accordance with the patient's drug requirements.

When an appropriate transmitted paging signal is picked up by one of the crystals 90 causing the relay contacts to close, a holding circuit is established for energizing the signal means 95 which will continue to emit an alarm signal, which in the FIG. 5 embodiment includes an audio and visual alarm with the use of a buzzer 96 and a light 98, until the holding circuit is disrupted in connection with the reset function. Herein, the holding circuit is broken by the actuation of a rotary step switch 100 which is carried at the top of the rotary member 82 and includes a series of contacts 102 with one contact provided for each of the sequenced detent positions as previously described.

The step switch contacts 102 are effectively rotated with the rotary member 82 and will momentarily break the holding circuit, causing the contacts 94 to open and stop the emitted alarm signal from the signal means 95 and reset the circuit in readiness for the reception of a subsequent paging signal transmission. Thus it will be seen that in resetting the circuit, by rotating the step switch 100 along with the rotary member 82, an appropriate pill is automatically dispensed from its chamber 80.

In some instances it may be desirable to provide an individual signal light 98 which would be responsive to an individual paging signal received by the crystals 90 as shown in the fragmentary circuit of FIG. 9. Herein each crystal would be provided with a signal light 98 and appropriate holding circuit including a relay coil 92 and relay contacts 94 wherein each signal light 98 may be color coded to match the color coding relating to the chambers 80.

Another embodiment of my invention is shown in FIG. 10 and comprises a portable automatic drug dispensing device 104 including a body member 105, a timing means 106 and a plurality of slide members 107, each having a pill receiving chamber 108 therein. The body member 105 is provided with a transparent cover plate 110 which overlies the slide members 107 and the timing means 106 and serves to enclose the pill receiving chambers 108 when the chambers are in their pill storing position. Thus the pills are retained in the chambers 108 while the device is being carried about and the pills may be observed in their chambers 108 through the transparent cover plate 110. The timing means 106 includes individual reset buttons 112 for each of the slide members 107 whereby activation of an appropriate slide member is effective to discontinue an emitted alarm signal produced by a signal means 114 associated with that slide member and also to reset the circuit for reception of a subsequent paging signal transmission. While the signal means 114, shown in FIG. 13, comprise signal lights 115 it should be understood that a sound producing signaling device may alternately be used. Further, the circuit may be adapted to use both visual and audio signal means as well as other suitable means which may effectively be used by a particular patient.

The circuit as shown in FIG. 13 is provided with a plurality of crystals 90*a*, preselected to respond to certain predetermined paging signals transmitted at given hours in accordance with a patient's requirements for medication similar in operation to the circuit shown in FIG. 9 for the drug dispensing device 70. The circuit is powered by a suitable power source 116 with a relay coil 118 and one of the reset buttons 112 connected in series with each of the crystals 90*a*. Herein, with the reception of an appropriate paging signal by one of the crystals 90*a*, a related signal light 115 is activated and remains activated by means of a relay contact 120 which is closed by energization of its relay coil 118 in response to an output signal by the crystal 90*a*. Thus a holding circuit is provided to continue the alarm signal produced by the signal means 114 until the proper reset button 112 is depressed to deenergize the relay coil 118 and accordingly open its relay contact 120 which terminates the alarm signal. The specific reset button 112 included in the portion of the circuit with an activated signal light 115 is of course depressed by pushing the appropriate slide member 107 against the bias of a compression spring 122 and into contact with the reset button 112. Now it will be seen that by pushing the slide member 107 against the reset button to stop the emitted alarm signal, that portion of the slide member having the pill receiving chamber 108 therein will automatically be shifted to an exposed pill dispensing position as shown in broken lines in FIG. 11. Thus an appropriate pill placed in the exposed chamber 108 is made accessible and may be administered to the patient. Obviously if the wrong slide member 107 is inadvertently pushed the signal means 114 will remain activated and indicate to the patient that he has errored. Thus the patient knows that a prescribed medicament scheduled to be taken at a given time will automatically be dispensed with the reset of the alarm signal activated portion of the circuit. The slide members 107 may also be conveniently coded by color or hour indications to facilitate loading the dispenser device 104, and with the same coding used on bottles and boxes in which the bulk drugs are kept. Thus a specific chamber 108 may be identified with specific drugs. The slide member 107 is returned to its normal position by the action of the spring 122.

Figure 14:
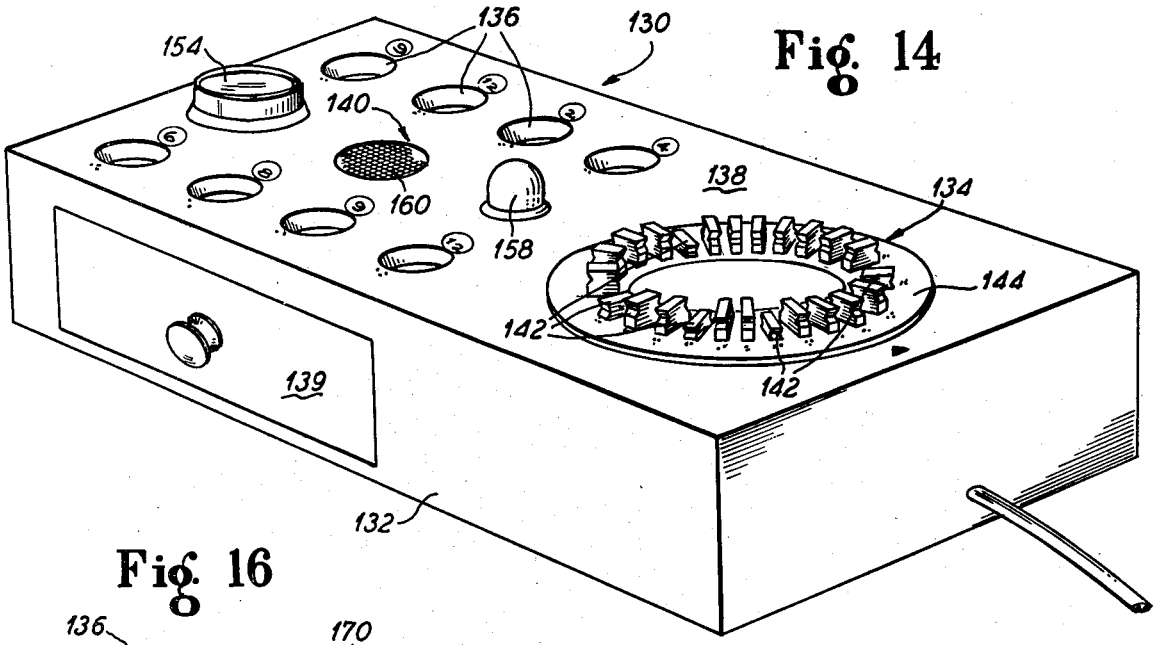
FIG. 14 is a perspective view of yet another embodiment of the present invention comprising a drug dispensing device for use in a fixed location.
Figure 16:
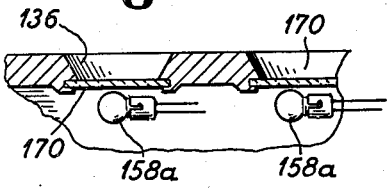
FIG. 16 is a fragmentary sectional view showing a variation in the signal device used with the FIG. 14 embodiment.

The embodiment illustrated in FIG. 14 provides a drug dispensing device 130 which may be used in the home or where the device may be placed in a generally fixed location. The dispensing device 130 includes a case 132 in which a timing means 134 is mounted and is provided with a plurality of drug receiving chambers 136 which may be conveniently formed in a top surface 138 of the case 132. The case 132 may afford sufficient space to accommodate a drawer 139 for the storage of drug supplies from which a daily supply of prescribed medicaments are selected and placed in the various chambers 136 in a predetermined order, and which preferably will be coded to facilitate loading and identification as previously described in connection with the various other dispensing devices.

The timing means 134, as shown, comprises a twenty-four hour standard type timing device which is pre-set to activate signal means 140, indicating the time at which prescribed drugs are to be taken. The timing device is pre-set by depressing specific push buttons 142 positioned about the timing device dial 144 and which corresponds to the specific instances when drugs are to be dispensed. These push buttons 142 may also be coded in a manner described in connection with the various embodiments described hereinabove.

Figure 15:
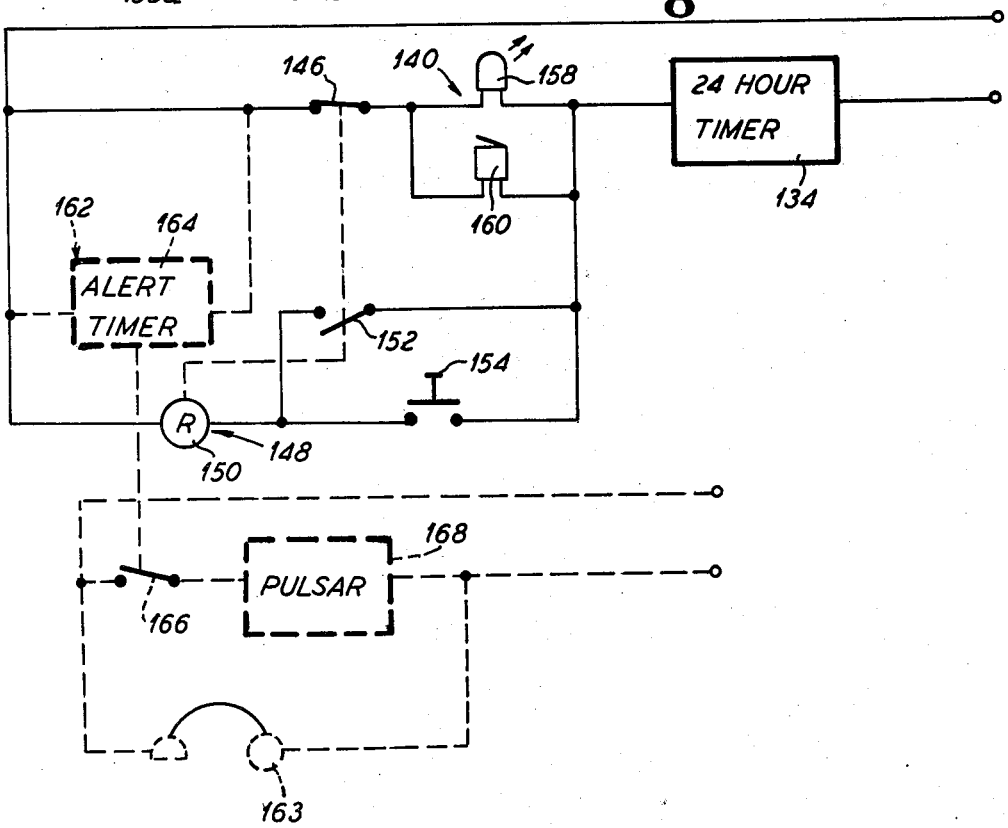
FIG. 15 is an electrical circuit diagram of the timing device used in the FIG. 14 embodiment.

The electrical circuit for this dispensing device, as shown in FIG. 15 is powered by standard house current with the signal means 140 being activated through a normally closed relay contact 146 of a relay 148. The relay 148 includes a relay coil 150 and a second relay contact 152 which is normally open. A reset button 154 is connected in series with the relay coil 150 and is effective to energize the relay coil when the button is pressed. Energization of the relay coil 150 opens its contact 146, thereby deactivating the signal means 140 including a signal light 158 and a buzzer 160; and also closes its relay contact 152 to establish a holding circuit to the relay coil 150. Thus the normally closed contact 146 is held open and the signal means remains deactivated.

In turn, and on a preset hour each of the depressed push buttons 142 is effective to cause a momentary disruption of power in the circuit which deenergizes the coil 150 of the relay 148. With the relay coil 150 deenergized, relay contact 152 opens and relay contact 146 closes. Following the momentary power disruption and when power is again restored, a circuit is provided through that portion of the circuit including the signal means 140 causing an alarm signal to be emitted therefrom. Depressing the push button 154 energizes the relay 148 to again establish the holding circuit and deactivate the signal means 140, in resetting the circuit for timing a subsequent interval between administering drug doses. This procedure is repeated in response to each momentary interruption of power in the circuit as caused by the preset buttons 142 of the timer means 134.

Chronically ill patients who are dependent on receiving prescribed drugs in timely doses may utilize an alerting device 162, incorporated into the dispensing device 130 and which is connected to a telephone system 163 to automatically send a preset signal over the phone indicating that help is needed if a patient is unable to reset the device and consequently unable to take required medication. Herein an alert timer 164 is connected in series with the signal means 140 and relay contact 146, which after being energized for a predetermined length of time closes contact 166 to connect a pulsar device 168 into the phone system 163 whereby an alerting communication is transmitted to appropriate parties, indicating that the patient is in need of help.

The circuit for the dispensing device 130 may be modified to provide an individual signal light 158*a* to identify a pill in a specific chamber 136 which is to be taken as determined by the preset timer means 134. Herein, a sequencing arrangement such as a step switch means may be incorporated into the circuit (not detailed) which will alternately activate each of the signal lights 158*a* in response to operation of the reset button 154. A transparent disc 170 forms the bottom wall of each chamber 136 allowing the signal light 158*a* to be seen from above and which will illuminate the appropriate chamber from which a pill is to be administered.

It should be recognized that various other timing means, signal means, pill container means and various other arrangement of the components illustrated or suggested in connection with specific embodiments of my invention, may be made to accommodate a specific patient's infirmity or mode of living and it is to be understood that these variations and modifications may be effected without departing from the spirit and scope of the novel concepts of this invention.

What I claim is:

1. An automatic periodic drug dispensing device for use in administering predetermined doses of pharmaceutical preparations to an individual comprising:

a plurality of drug storage chambers each adapted to receive a prescribed medicament and being arranged in a predetermined sequence and with a given capacity for dispensing the medicaments over a given time period, a timing means being discernible by a user of the prescribed medicaments, an automatic signal means associated with said timing means and arranged to identify specific times when each of said prescribed medicaments is to be taken, and a coding means associated with each of said plurality of drug storage chambers and said timing means, whereby said prescribed medicaments may be identified for dispensing in a predetermined time sequence, said dispensing device comprising a self-contained unit and said timing means includes an electrical circuit having means to energize said automatic signal means at preselected times to emit discernible alarm signals, wherein said electrical circuit includes a holding circuit and a reset means whereby said holding circuit is adapted to maintain the signal means in an energized state until deactivated by the reset means, and wherein said reset means deactivates said signal means coincidentally with the dispensing of an appropriate medicament.

2. The drug dispensing device according to claim 1, wherein said signal means includes a plurality of signal elements, individually activated by the means to energize said automatic signal means to identify the specific drug storage chamber from which a prescribed medicament is to be administered at a given time.

3. The drug dispensing device according to claim 1, wherein said plurality of drug storage chambers are incorporated into a series of slide members, each being movable from a pill storage position to a pill dispensing position and said reset means includes individual reset buttons, one associated with each of the series of slide members wherein a specific drug storage chamber is automatically moved to the pill dispensing position coincidental with actuation of a related reset button to deenergize said signal means by the movement of a related one of said slide members.

4. The drug dispensing device according to claim 1, wherein said means to energize said automatic signal means includes a twenty-four hour timer.

5. The drug dispensing device according to claim 4, wherein said signal means includes a plurality of signal elements, individually activated by said twenty-four hour timer to identify the specific drug storage chamber from which a prescribed medicament is to be administered at a given time.

6. An automatic periodic drug dispensing device for use in administering predetermined doses of pharmaceutical preparations to an individual comprising:

a plurality of drug storage chambers each adapted to receive a prescribed medicament and being arranged in a predetermined sequence and with a given capacity for dispensing the medicaments over a given time period, a timing means being discernible by a user of the prescribed medicaments, an automatic signal means associated with said timing means and arranged to identify specific times when each of said prescribed medicaments is to be taken, and a coding means associated with each of said plurality of drug storage chambers and said timing means, whereby said prescribed medicaments may be identified for dispensing in a predetermined time sequence, said dispensing device comprising a portable, self-contained unit and said timing means includes an electrical circuit having means to energize said automatic signal means at preselected times to emit discernible alarm signals, wherein said means to energize said automatic signal means comprises a plurality of crystal detectors, each adapted to detect an individual, predetermined signal transmission and responsive thereto to activate said automatic signal means.

7. The drug dispensing device according to claim 6, wherein said signal means includes an auditory signaling device to designate times of drug dispensing.

8. The drug dispensing device according to claim 6, wherein said signal means includes a visual signaling device to designate times of drug dispensing.

9. The drug dispensing device according to claim 6, wherein said plurality of drug storage chambers are incorporated into a rotary member which is indexable to position each of said drug storage chambers in a pill dispensing position in a predetermined sequence.

10. The drug dispensing device according to claim 9, wherein said timing means includes a reset means incorporated into the rotary member whereby turning the rotary member is effective to deenergize the signal means and reset the timing means for a subsequent energization of said signal means and commensurate therewith to automatically position a specific one of the drug storage chambers in a pill dispensing position.

11. An automatic periodic self-contained drug dispensing device for use in administering predetermined doses of pharmaceutical preparations in a given order and at a given time comprising:

a plurality of drug storage chambers, each adapted to receive a prescribed drug, which drugs are to be administered over a given time period;

a timing means including an automatic signal means and an energizing means adapted to activate said means at preselected times to emit discernible alarm signals which are arranged to identify specific times and specific order of administering said prescribed drugs, said energizing means includes a holding circuit and a reset means whereby said holding circuit is adapted to hold the signal means in an energized condition until deactivated by the reset means, and wherein said reset means deactivates said signal means coincidental with dispensing of an appropriate pharmaceutical preparation from an appropriate one of said plurality of drug storage chambers.

12. The drug dispensing device according to claim 11, wherein said energizing means includes a twenty-four hour timer.

13. An automatic periodic self-contained drug dispensing device for use in administering predetermined doses of pharmaceutical preparations in a given order and at a given time comprising:

a plurality of drug storage chambers, each adapted to receive a prescribed drug, which drugs are to be administered over a given time period;

a timing means including an automatic signal means and an energizing means adapted to activate said signal means at preselected times to emit discernible alarm signals which are arranged to identify specific times and specific order of administering said prescribed drugs, said energizng means includes a holding circuit and a reset means whereby said holding circuit is adapted to hold the signal means in an energized condition until deactivated by the reset means, said energizing means further includes a plurality of crystal detectors, each adapted to detect an individual, predetermined signal transmission and responsive thereto to activate said automatic signal means.

* * * * *